US009267399B2

(12) United States Patent
Kohler et al.

(10) Patent No.: US 9,267,399 B2
(45) Date of Patent: Feb. 23, 2016

(54) CONTROL VALVE OF A CAMSHAFT ADJUSTER

(71) Applicant: Schaeffler Technologies GmbH & Co. KG, Herzogenaurach (DE)

(72) Inventors: David Kohler, Egloffstein (DE); Markus Kinscher, Lauf a.d. Pegnitz (DE); Ali Bayrakdar, Rothenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/408,420

(22) PCT Filed: Apr. 12, 2013

(86) PCT No.: PCT/EP2013/057643
§ 371 (c)(1),
(2) Date: Dec. 16, 2014

(87) PCT Pub. No.: WO2013/189621
PCT Pub. Date: Dec. 27, 2013

(65) Prior Publication Data

US 2015/0204217 A1 Jul. 23, 2015

(30) Foreign Application Priority Data

Jun. 18, 2012 (DE) ..... 10 2012 210 178

(51) Int. Cl.
*F01L 1/34* (2006.01)
*F01L 1/344* (2006.01)

(52) U.S. Cl.
CPC ..... *F01L 1/3442* (2013.01); *F01L 2001/34423* (2013.01); *F01L 2001/34426* (2013.01); *F01L 2001/34433* (2013.01); *F01L 2001/34453* (2013.01); *F01L 2001/34459* (2013.01)

(58) Field of Classification Search
CPC ..... F01L 1/3442; F01L 2001/34423; F01L 2001/34426; F01L 2001/34433
USPC ..... 123/90.12, 90.17
See application file for complete search history.

(56) References Cited

U.S. PATENT DOCUMENTS 6,363,896 B1 4/2002 Speier
7,849,825 B2 * 12/2010 Scheidig et al. ..... F01L 1/34 123/90.12
2011/0259289 A1 10/2011 Fujiyoshi

FOREIGN PATENT DOCUMENTS

DE 19817319 10/1999
WO 2010015541 2/2010

* cited by examiner

*Primary Examiner* — Ching Chang
(74) *Attorney, Agent, or Firm* — Volpe and Koenig, P.C.

(57) ABSTRACT

A control valve (1) of a camshaft adjuster, which has a housing (2) having three pin openings (5*a*, 5*b*, 5*c*), spaced apart axially from each other, wherein two pin openings (5*a*, 5*b*) are each connected to the tank connection (T) in two axial positions of the control piston (4) and the third pin opening (5*c*) is not connected to the tank connection (T) in a third axial position of the control piston (4) in a fluid-conducting manner.

10 Claims, 2 Drawing Sheets

Fig. 2a (1. Position)
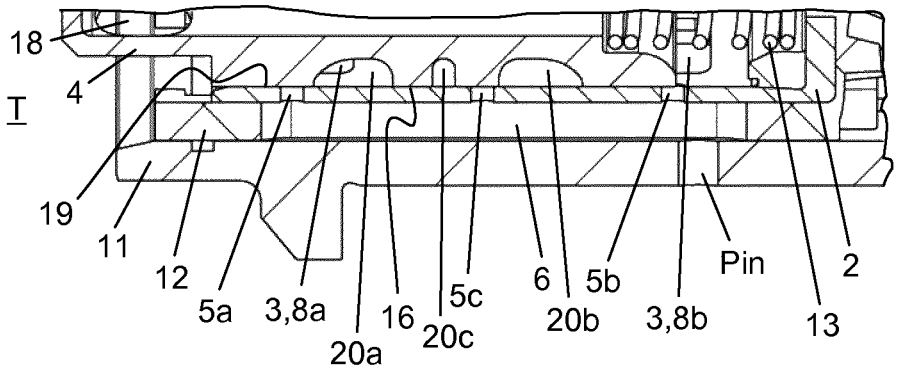
Fig. 2b (2. Position)
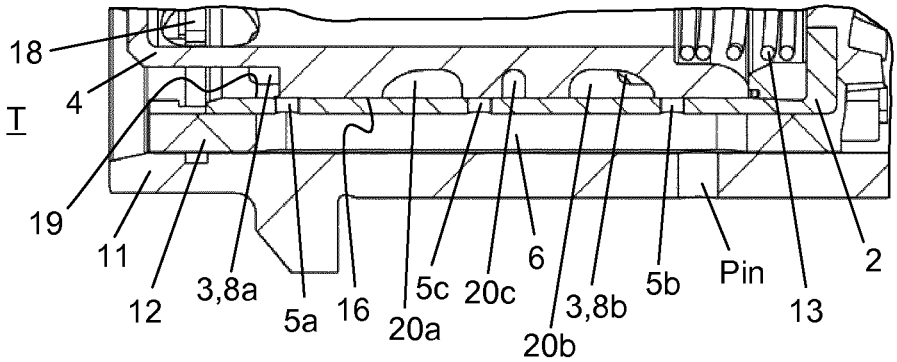
Fig. 2c (3. Position)
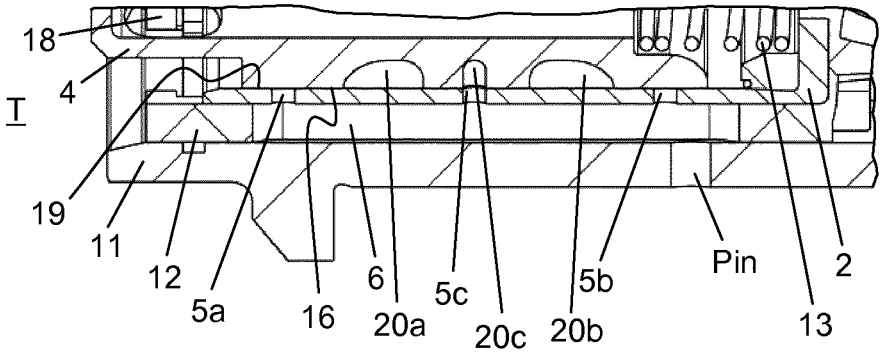

CONTROL VALVE OF A CAMSHAFT ADJUSTER

FIELD OF THE INVENTION

The invention relates to a control valve of a camshaft adjuster.

BACKGROUND

Camshaft adjusters are used in internal combustion engines to vary the control times of the combustion chamber valves in order to be able to variably configure the phase relationship between a crankshaft and a camshaft in a defined angle range, between a maximum early and a maximum late position. The adjustment of the control times to the current load and rotational speed reduces fuel consumption and emissions. For this purpose, camshaft adjusters are integrated in a drivetrain via which a torque is transmitted by the crankshaft to the camshaft. This drivetrain can be formed, for example, as a belt, chain or gear drive.

In the case of a hydraulic camshaft adjuster, the drive output element and the drive input element form one or more pairs of pressure chambers which act counter to one another and on which hydraulic medium can act. The drive input element and the drive output element are arranged coaxially. A relative movement between the drive input element and the drive output element is generated by filling and emptying individual pressure chambers. The spring which acts rotationally between the drive input element and the drive output element pushes the drive input element in an advantageous direction with respect to the drive output element. This advantageous direction can be in the same direction or in an opposite direction to the direction of rotation.

One design of the hydraulic camshaft adjuster is the vane-cell adjuster. The vane-cell adjuster has a stator, a rotor and a drive input wheel with an external toothing. The rotor is formed as a drive output element so that it can usually be connected in a rotationally fixed manner to the camshaft. The drive input element contains the stator and the drive input wheel. The stator and the drive input wheel are connected to one another in a rotationally conjoint manner or are alternatively formed in one piece with one another. The rotor is arranged coaxially with respect to the stator and within the stator. The rotor and the stator are formed with their radially extending vanes, oppositely acting oil chambers, which can be acted upon by oil pressure and enable a relative rotation between the stator and the rotor. The vanes are formed either in one piece with the rotor or the stator or arranged as a "connected vane" in grooves provided for this purpose of the rotor or the stator. The vane adjusters furthermore have various sealing covers. The stator and the sealing covers are secured to one another by means of several screw connections.

Another design of the hydraulic camshaft adjuster is the axial piston adjuster. In this case, a displacement element is axially displaced by means of oil pressure, which displacement element generates by means of helical gearings a relative rotation between a drive input element and a drive output element.

The control valves of the hydraulic camshaft adjuster control the flow of hydraulic medium between the camshaft adjuster and the oil pump or the oil reservoir (tank).

The control valve has a hollow cylindrical housing and a rotationally symmetrical control piston. The control piston is arranged within the housing of the control valve. The control piston is movable in the axial direction and is guided by the housing. The control piston can thus be positioned in any desired axial position with respect to the housing. The positioning is carried out by an electromagnet which, with its actuating pin, contacts one end of the control piston and can displace the control piston. A spring ensures contact between the control piston and the actuating pin. As a result of the axial positioning of the control piston, the various connections of the control valve are hydraulically connected to one another or separated from one another and can thus communicate with one another or not. Control pistons and housings with openings, e.g. grooves and/or bores, are provided between the connections in order to conduct the hydraulic medium. The control piston has control edges which, together with the edges of the openings of the housing, control the flow rate. The control edges themselves are the edges of the respective opening, e.g. grooves, of the control piston. In order to control the flow rate, the edges of the openings of the housing and the control edges are positioned in relation to one another in such a manner that an opening of the housing is as far as possible opposite an opening of the control piston and forms a flow-through surface for the hydraulic medium which is variable via the capacity to axially position the control piston.

A control valve formed as a central valve is arranged coaxially with respect to the axis of symmetry or rotation of the camshaft adjuster or the camshaft. The central valve is additionally placed within the camshaft adjuster, i.e. the central valve and camshaft adjuster are constructed in a radial direction to one another. The camshaft can optionally be arranged between the camshaft adjuster and the central valve. The housing of the central valve can be formed as a central screw, by which the camshaft adjuster is connected in a rotationally fixed manner to the camshaft. The electromagnet is arranged as a central magnet as far as possible flush with the central valve and is normally arranged fixed on the frame, in particular on the cylinder head.

Alternatively, a control valve with an electromagnet arranged fixedly thereon can be arranged at any desired position in the hydraulic medium gallery, outside the camshaft adjuster and the camshaft, and can control the flow of hydraulic medium.

WO 2010/015541 A1 shows a camshaft adjuster with a central valve. The central valve has two intake connections, wherein one is arranged coaxially with respect to the central valve and the other is arranged radially with respect to the central valve. The intake connections are formed as bores. The central bore furthermore possesses two working connections on the outer circumference which are opposite the hydraulic medium channels to the pressure chambers. The tank connection is arranged on the side which faces away from the camshaft in order to supply hydraulic medium to be displaced into the reservoir of the internal combustion engine.

DE 198 17 319 A1 shows a central valve of a camshaft adjuster. The intake connection is arranged on the outer circumference of the central valve. The intake connection is flanked in the axial direction by both working connections. The tank connection is located on that end of the central valve which faces towards the camshaft and opens into a radial bore of the camshaft.

SUMMARY

The object of the invention is to indicate a control valve of a camshaft adjuster which enables an improved actuation of the hydraulic camshaft adjuster.

This object is achieved according to the invention.

A control valve of a camshaft adjuster, wherein hydraulic medium flows through the control valve for control of the camshaft adjuster and the control valve has an intake connection, several working connections, a pin connection, and a tank connection, wherein the control valve has a hollow cylindrical housing with several openings and a control piston which is axially movable in the housing, wherein an internal casing surface of the housing guides the control piston and the control piston can be axially positioned in order to thus control the flow of hydraulic medium between the connections through the openings, achieves the object according to the invention in that the housing has three pin openings which are axially spaced apart from one another, which pin openings are connected to the pin connection in a fluid-conducting manner, wherein two pin openings are connected in each case in two axial positions of the control piston to the tank connection in a fluid-conducting manner and the third pin opening is not connected in a third axial position of the control piston to the tank connection in a fluid-conducting manner.

Hydraulic medium is supplied by the oil pump via the intake connection of the control valve. The various axial positions of the control piston distribute the hydraulic medium to the working connections, which are connected to the working chambers of the camshaft adjuster in a fluid-conducting manner, and to the pin connection, which is connected to a locking mechanism of the camshaft adjuster in a fluid-conducting manner. The hydraulic medium is discharged via the tank connection from the camshaft adjuster to the oil reservoir depending on the axial position of the control piston.

In the case of a corresponding filling or emptying, known from the prior art, of the working chambers of the camshaft adjuster with hydraulic medium, the drive input element can be rotated with respect to the drive output element.

The locking mechanism of the camshaft adjuster occupies its unlocked state in the case of the hydraulic medium supplied via the pin connection to the locking mechanism, as a result of which the drive input element can be rotated with respect to the drive output element. If the pin connection is connected to the tank connection by means of the control piston, hydraulic medium does not act upon the locking mechanism and the locking mechanism occupies the locked state, as a result of which the drive input element can no longer be rotated with respect to the drive output element.

In one configuration of the invention, in the first axial position of the control piston, the first pin opening for a flow of hydraulic medium is blocked, the second pin opening is connected to the tank connection in a fluid-conducting manner and the third pin opening for a flow of hydraulic medium is blocked. Hydraulic medium is advantageously only conducted through the second pin opening to the tank in this first axial position of the control piston.

In a further configuration of the invention, the first axial position of the control piston is reached in a first end position of the control piston. The first end position can advantageously correspond to a position which is actuated or unactuated by an electromagnet, as a result of which the hydraulic medium can be discharged through the second pin opening in a stable and unregulated axial position of the control piston and as a result the locking mechanism of the camshaft adjuster can occupy the locked state. In the first end position, the control piston strikes against a first end stop.

In one configuration of the invention, in the second axial position of the control piston, the first pin opening is connected to the tank connection in a fluid-conducting manner, the second pin opening for a flow of hydraulic medium is blocked and the third pin opening for a flow of hydraulic medium is blocked. In this second axial position of the control piston, hydraulic medium is advantageously only conducted through the first pin opening to the tank.

In a further configuration of the invention, the second axial position of the control piston is reached in a second end position of the control piston. The second end position can advantageously correspond to a position which is actuated or unactuated by an electromagnet, as a result of which the hydraulic medium can be discharged through the first pin opening in a stable and unregulated axial position of the control piston and as a result the locking mechanism of the camshaft adjuster can occupy the locked state. In the second end position, the control piston strikes against a second end stop.

In one configuration of the invention, in the third axial position of the control piston, the first pin opening for a flow of hydraulic medium is blocked, the second pin opening for a flow of hydraulic medium is blocked and the third pin opening is connected to the intake connection in a fluid-conducting manner. In this third axial position of the control piston, hydraulic medium is advantageously only conducted through the third pin opening, proceeding from the intake connection, as a result of which the locking mechanism can occupy the unlocked state.

In one configuration of the invention, in the third axial position of the control piston, the first pin opening for a flow of hydraulic medium is blocked, the second pin opening for a flow of hydraulic medium is blocked and the third pin opening is connected to one of the working connections in a fluid-conducting manner. In this third axial position of the control piston, hydraulic medium is advantageously only conducted through the third pin opening, proceeding from one of the working connections, as a result of which the locking mechanism can occupy the unlocked state.

In a further configuration of the invention, the third axial position of the control piston is reached between the two end positions of the control piston. The locking mechanism can thus most preferably be actuated in a regulated position, which is different from the end positions, of the control piston and can occupy its unlocked state, as a result of which the camshaft adjuster is able to perform adjustment. In the end positions of the control piston, however, the locking mechanism is reliably in its locked state as a result of the connection of the pin connection to the tank connection. A locked locking mechanism is advantageous particularly in the case of failed actuation by the electromagnet or when starting the engine or stopping the engine. The end positions can furthermore be occupied by the control piston in a stable and reliable manner, as a result of which the reliability of the actuation is improved. In this case, the control piston does not contact any of the two end stops.

In a further configuration of the invention, the control valve has a pin channel which runs in the axial direction and connects the three pin openings jointly to the pin connection in a fluid-conducting manner. The three pin openings are connected in a fluid-conducting manner by the pin channel.

In a further configuration of the invention, the third pin opening is arranged between the first and the second pin opening. The locking mechanism can thus most preferably be actuated in a regulated axial position of the control piston and can occupy its unlocked state, as a result of which the camshaft adjuster is able to perform adjustment, i.e. the camshaft adjuster is only able to perform adjustment after the actuation has been performed by the electromagnet.

In one preferred configuration, the locking mechanism locks the camshaft adjuster in the central position. The central position is advantageous in order to reliably start the internal combustion engine when starting the engine.

In one particularly preferred configuration of the invention, the control valve is formed as a central valve. The central valve is advantageously arranged radially within the camshaft adjuster or the camshaft. Short hydraulic paths from the central valve to the camshaft adjuster result in a reduced control delay and thus the arrangement close to the camshaft adjuster improves the performance of the entire camshaft adjustment system.

As a result of the formation according to the invention of the control piston, a connection configuration is enabled in the case of which the locking of the camshaft adjuster is locked in the end positions of the control piston.

BRIEF DESCRIPTION OF THE DRAWINGS

Exemplary embodiments of the invention are represented in the figures.

In the figures:

FIG. 2*a* shows a partial representation of the central valve according to FIGS. 1*a* and 1*b* with its control piston in its first position, FIG. 2*b* shows a partial representation of the central valve according to FIGS. 1*a* and 1*b* with its control piston in its second position, and FIG. 2*c* shows a partial representation of the central valve according to FIGS. 1*a* and 1*b* with its control piston in its third position.

DETAILED DESCRIPTION OF THE PREFERRED EMBODIMENTS

Figure 1A:
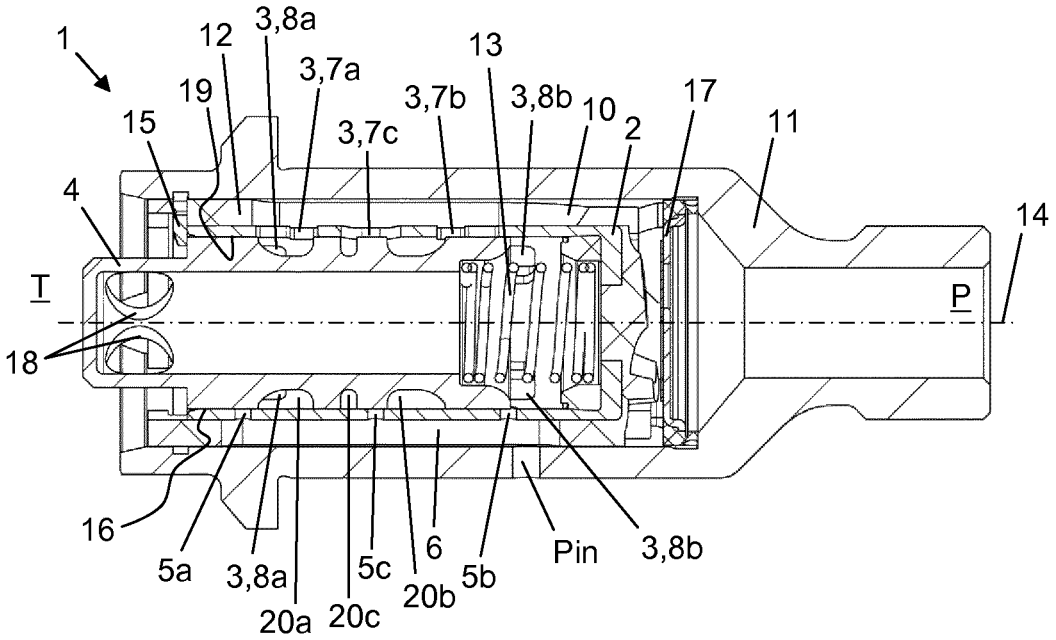
FIG. 1*a* shows a longitudinal section of the control valve according to the invention formed as a central valve.

FIG. 1*a* shows a longitudinal section of control valve 1 according to the invention formed as a central valve.

Control valve 1 has a hollow cylindrical central screw 11, a housing insert 12, a hollow cylindrical housing 2, a control piston 4, a retaining ring 15 and a pressure spring 13. All the above-mentioned components are arranged coaxially with respect to one another and with respect to a common axis of rotation 14, which, after mounting of control valve 1 to a camshaft adjuster and to a camshaft, is also axis of rotation 14 of the camshaft adjuster or the camshaft.

The hollow cylindrical central screw 11 is provided for rotationally fixed fastening of the camshaft adjuster to the camshaft. The housing insert 12 is received by an inner circumference of central screw 11. The housing insert 12 has an intake channel 10, several working channels 9*a*, 9*b* and a pin channel 6 which extend in the radial direction and can conduct the hydraulic medium parallel to axis of rotation 14. The housing 2 furthermore has several intake openings 7*a*, 7*b*, 7*c*, several working openings 8*a*, 8*b* and three pin openings 5*a*, 5*b*, 5*c* which are connected to the above-mentioned channels in a fluid-conducting manner in order to conduct hydraulic medium from an intake connection P of control valve 1 to workings connections A, B, tank connection T and pin connection Pin. The working connections A, B are arranged as radial bores at different positions on the outer circumference of the control valve 1 or the central screw 11. The intake connection P is located on the thread-side face side of the central screw 11 or of the control valve 1. The tank connection T is located on the face side of the central screw 11 or of the control valve 1 opposite the intake connection P. The tank connection T has several tank openings 18 formed by the control piston 4. The tank openings 18 are arranged on the face side end, which faces the tank connection T, of the control piston 4 and are formed as radial bores in order to conduct hydraulic medium from the interior of the control piston 4 to the tank connection.

Pressure spring 13 exerts a force on the control piston 4 and the control piston 4 is pressed against a retaining ring 15. The retaining ring 15 secures the axial position of the housing insert 12 and of the control piston 4 within the central screw 11. The pressure spring 13 is supported on one hand on the control piston 4 and on the other hand on the housing insert 12 or on the housing 2.

The control piston 4 is guided by an internal casing surface 19 of the housing 2. The control edges known from the prior art are located on the outer circumference 16 of the control piston 4. The flow-through surface of an opening of the housing 2 can be varied by means of the control edges, for example, by the working openings 8*a*, 8*b* in order to supply or discharge a certain amount of hydraulic medium to the working chambers of the camshaft adjuster in a targeted manner. The working chambers of the camshaft adjuster are known from the prior art and generate the relative adjustment between camshaft and crankshaft in the case of filling with hydraulic medium. The pin connection Pin is connected to a locking mechanism of the camshaft adjuster in a fluid-conducting manner. The locking mechanism is known to lock the camshaft adjuster in its angular position in the intermediate position, ideally in the central position which is also known.

Figure 1B:
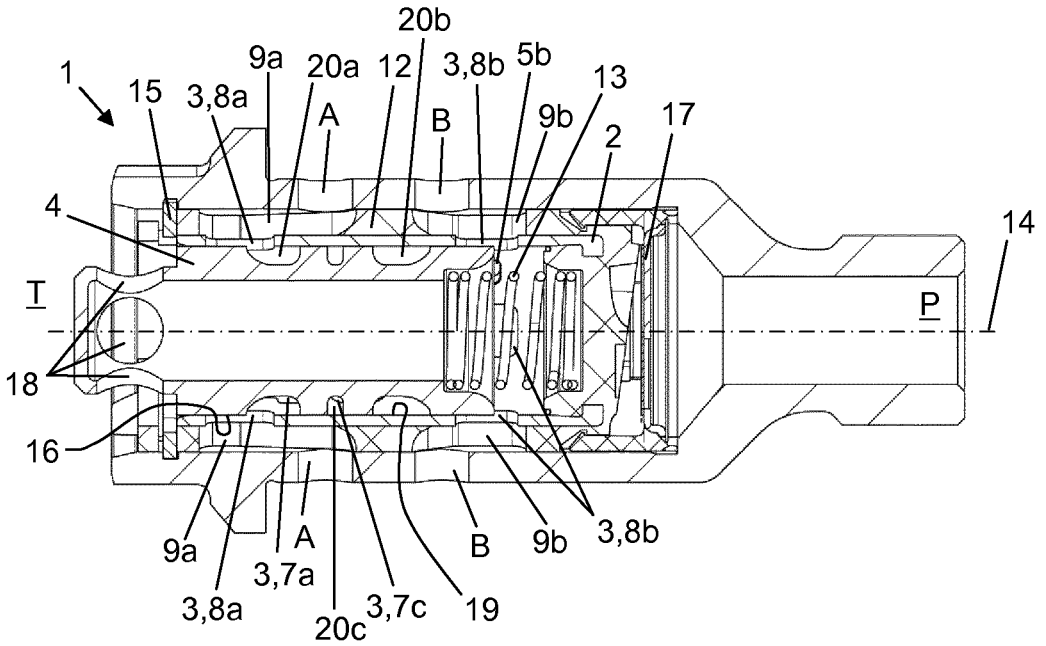
FIG. 1*b* shows a further longitudinal section of the control valve according to FIG. 1*a*, which is offset by 45° about the axis of rotation with respect to the longitudinal section from FIG. 1*a*.

FIG. 1*b* shows a further longitudinal section of the control valve according to FIG. 1*a*, which is offset by 45° about the axis of rotation with respect to the longitudinal section from FIG. 1*a*. Working channels 9*a* of the housing insert 12 connect the working connection A formed as a plurality of radial bores distributed over the circumference to the working openings 8*a*, which are distributed as a plurality over the circumference, of the housing 2 in a fluid-conducting manner. Each working channel 9*a* is formed as an axial slot of the housing insert 12 and is delimited in the radial direction by the central screw 11 and the housing 2.

The working channels 9*b* of the housing insert 12 connect the working connection B formed as a plurality of radial bores distributed over the circumference to the working openings 8*b*, which are distributed as a plurality over the circumference, of the housing 2 in a fluid-conducting manner. Each working channel 9*b* is formed as an axial slot of the housing insert 12 and is delimited in the radial direction by the central screw 11 and the housing 2. Both the working connection B and the working channels 9*b* and the working openings 8*b* are arranged axially spaced apart respectively by the working connection A and the working channels 9*a* and the working openings 8*a*.

The intake opening 7*a*, from which the hydraulic medium can be conducted via a groove 20*a* of the control piston 4 on the circumferential side up to the working opening 8*a*, is visible below the line of symmetry or axis of rotation 14. The groove 20*c*, which can distribute the hydraulic medium from the intake opening 7*c* across the circumference, is axially adjacent to the groove 20*a*. In this position of the control piston 4, there is no further opening opposite the groove 20*c* via which the hydraulic medium can flow out. The groove 20*b*, which can distribute the hydraulic medium from the intake opening 7*b* across the circumference, is axially adjacent to the groove 20*c*. In this position of the control piston 4, there is no further opening opposite the groove 20*b* via which the hydraulic medium can flow out.

The flow of hydraulic medium between the individual connections A, B, P, T and Pin as a function of the axial position of the control piston 4 is described in FIGS. 2*a*-2*c*.

FIG. 2*a* shows a partial representation of the central valve according to FIGS. 1*a* and 1*b* with its control piston 4 in its first position.

In this first position, the control piston 4 is advantageously unactuated by an electromagnet, in particular a central magnet arranged coaxially with respect to axis of rotation 14. The pressure spring 13 pushes the control piston 4 against above-mentioned retaining ring 15 into its first end position.

As already described in FIGS. 1*a* and 1*b*, the hydraulic medium can travel from the intake connection P via the intake channel 10 through the intake opening 7*a* into the groove 20*a*. The hydraulic medium is distributed on the circumferential side from the groove 20*a* and can travel through the working opening 8*a* to the working channel 9*a* and finally to the working connection A and be supplied further to the first working chamber of the camshaft adjuster. At the same time, hydraulic medium is conducted out of the second working chamber of the camshaft adjuster via the working connection B via the working channel 9*b* through the working opening 8*b* to the interior space of the central valve and can flow out through the interior via the tank openings 18 to tank connection T. The camshaft adjuster thus adjusts its drive input element with respect to its drive output element in a first circumferential direction.

At the same time, hydraulic medium can flow out from the locking mechanism of the camshaft adjuster via the pin connection Pin, which is formed as a radial bore, into the pin channel 6. This hydraulic medium is also conducted through the pin opening 5*b* beyond the edge of the face side of the control piston 4 into the interior of the central valve and discharged to the tank connection T. The pin bores 5*a* and 5*c* remain sealed off from the outer circumference of the control piston 4. The grooves 20*c* and 20*b* are indeed filled with hydraulic medium through respective intake openings 7*c* and 7*b*, but cannot distribute the hydraulic medium to a further opening.

FIG. 2*b* shows a partial representation of the central valve according to FIGS. 1*a* and 1*b* with its control piston in its second position.

In this second position, the control piston 4 is advantageously actuated by an electromagnet, in particular a central magnet arranged coaxially with respect to the axis of rotation 14. The pressure spring 13 is fully compressed and the control piston 4 has the maximum distance to above-mentioned retaining ring 15. The control piston 4 contacts the housing insert 12 in its second end position with its face side.

The hydraulic medium can thus travel from the intake connection P via the intake channel 10 through the intake opening 7*b* into the groove 20*b*. The hydraulic medium is distributed on the circumferential side from groove 20*b* and can travel through working opening 8*b* to working channel 9*b* and finally to working connection B and be supplied further to the second working chamber of the camshaft adjuster. At the same time, hydraulic medium is conducted out of the first working chamber of the camshaft adjuster via the working connection A via the working channel 9*a* through the working opening 8*a* to a radial gap, which is present in this position and is formed by a graduation on the outer circumference of the control piston 4, between the control piston 4 and the housing 2 in the axial direction and can flow out via here to the tank connection T without flowing through the tank openings 18. The camshaft adjuster thus adjusts its drive input element with respect to its drive output element in a second circumferential direction which is opposite to the first.

At the same time, hydraulic medium can flow out from the locking mechanism of the camshaft adjuster via the pin connection Pin, which is formed as a radial bore, into the pin channel 6. This hydraulic medium is also conducted through the pin opening 5*a* beyond the edge of the face side of the control piston 4 and discharged to the tank connection T. The pin bores 5*b* and 5*c* are sealed off from the outer circumference of the control piston 4. The grooves 20*c* and 20*a* are indeed filled with hydraulic medium through respective intake openings 7*c* and 7*a*, but cannot distribute the hydraulic medium to a further opening.

FIG. 2*c* shows a partial representation of the central valve according to FIGS. 1*a* and 1*b* with its control piston in its third position.

In this third position, the control piston 4 is advantageously actuated by an electromagnet, in particular a central magnet arranged coaxially with respect to the axis of rotation 14. The pressure spring 13 is fully compressed and the control piston 4 has a distance to above-mentioned retaining ring 15 and to a face-side support surface of the housing insert 12. The control piston 4 is thus positioned between the first and the second end position, ideally spaced apart centrally and equally from both its end positions.

The hydraulic medium can thus travel from the intake connection P via the intake channel 10 through the intake opening 7*c* into the groove 20*c*. The hydraulic medium is distributed on the circumferential side from the groove 20*c* and can travel through the pin opening 5*c* to the pin channel 6 and finally to the pin connection Pin and be supplied further to the locking mechanism of the camshaft adjuster. The locking mechanism is thus exposed to the hydraulic medium pressure and, depending on the configuration of the locking mechanism, either unlocks or locks. In this exemplary embodiment, the locking mechanism is unlocked in the presence of hydraulic medium pressure.

At the same time, the hydraulic medium can travel from the intake connection P via the intake channel 10 through the intake openings 7*a* and 7*b* into the corresponding grooves 20*a* and 20*b*. The grooves 20*a* and 20*b* are indeed filled with hydraulic medium through the respective intake openings 7*a* and 7*b*, but cannot distribute the hydraulic medium to a further opening and thus not to the working connections A and B. The camshaft adjuster does not perform adjustment and its drive input element is stuck in its angular position with respect to its drive output element.

With this actuation, the drive input element can advantageously maintain its angular position with respect to the drive output element and simultaneously unlock the locking mechanism. If the control piston 4 is in one of its end positions, hydraulic medium pressure does not act on the locking mechanism and the locking mechanism can engage into its locking gate in so far as a locking piston is opposite a locking gate. At the same time, the camshaft adjuster can perform adjustment in both end positions of the control piston 4. In this case, the first end position of the control piston 4 is particularly advantageous in which the control piston 4 is unactuated. If the electromagnet fails as a result of a fault, due to the formation according to the invention of the control valve 1, the camshaft adjuster will perform adjustment in this mode in a circumferential direction and at the same time enable locking of the locking mechanism.

LIST OF REFERENCE NUMBERS

1) Control valve
2) Housing
3) Openings

4) Control piston
5*a*) Pin opening
5*b*) Pin opening
5*c*) Pin opening
6) Pin channel
7*a*) Intake opening
7*b*) Intake opening
7*c*) Intake opening
8*a*) Working opening
8*b*) Working opening
9*a*) Working channel
9*b*) Working channel
10) Intake channel
11) Central screw
12) Housing insert
13) Pressure spring
14) Axis of rotation
15) Retaining ring
16) Outer circumference
17) Non-return valve
18) Tank opening
19) Internal casing surface
20*a*) Groove
20*b*) Groove
20*c*) Groove
A) Working connection
B) Working connection
P) Intake connection
T) Tank connection
Pin) Pin connection

The invention claimed is:

1. A control valve of a camshaft adjuster, wherein hydraulic medium flows through the control valve for control of the camshaft adjuster, the control valve comprising an intake connection (P), several working connections (A, B), a pin connection (Pin) and a tank connection (T) and a hollow cylindrical housing with several openings, a control piston which is axially movable in the housing, an internal casing surface of the housing guides the control piston, and the control piston is axially positioned in order to thus control the flow of hydraulic medium between the said connections (P, T, A, B, Pin) through the openings, the hollow cylindrical housing has first, second, and third pin openings which are axially spaced apart from one another, said pin openings are connected to the pin connection (Pin) in a fluid-conducting manner, wherein the first and second ones of the pin openings are connected in each case in first and second axial positions of the control piston to the tank connection (T) in a fluid-conducting manner and the third pin opening is not connected in a third axial position of the control piston to the tank connection (T) in a fluid-conducting manner.

2. The control valve as claimed in claim 1, wherein in the first axial position of the control piston, the first pin opening for a flow of hydraulic medium is blocked, the second pin opening is connected to the tank connection (T) in a fluid-conducting manner, and the third pin opening for a flow of hydraulic medium is blocked.

3. The control valve as claimed in claim 1, wherein the first axial position of the control piston is reached in a first end position of the control piston.

4. The control valve as claimed in claim 1, wherein in the second axial position of the control piston, the first pin opening is connected to the tank connection (T) in a fluid-conducting manner, the second pin opening for a flow of hydraulic medium is blocked, and the third pin opening for a flow of hydraulic medium is blocked.

5. The control valve as claimed in claim 1, wherein the second axial position of the control piston is reached in a second end position of the control piston.

6. The control valve as claimed in claim 1, wherein in the third axial position of the control piston, the first pin opening for a flow of hydraulic medium is blocked, the second pin opening for a flow of hydraulic medium is blocked, and the third pin opening is connected to the intake connection (P) in a fluid-conducting manner.

7. The control valve as claimed in claim 1, wherein in the third axial position of the control piston, the first pin opening for a flow of hydraulic medium is blocked, the second pin opening for a flow of hydraulic medium is blocked, and the third pin opening is connected to one of the working connections (A, B) in a fluid-conducting manner.

8. The control valve as claimed in claim 6, wherein the third axial position of the control piston is reached between two end positions of the control piston.

9. The control valve as claimed in claim 1, wherein the control valve has a pin channel which extends in the axial direction and connects the first, second, and third pin openings jointly to the pin connection (Pin) in a fluid-conducting manner.

10. The control valve as claimed in claim 1, wherein the third pin opening is arranged between the first and the second pin openings.

* * * * *